United States Patent [19]

Zuuring

[11] 4,150,837

[45] Apr. 24, 1979

[54] SKATE BLADE SUPPORT

[75] Inventor: Peter F. Zuuring, Laval des Rapides, Canada

[73] Assignee: PFZ Enterprises Inc., Montreal, Canada

[21] Appl. No.: 869,768

[22] Filed: Jan. 16, 1978

[51] Int. Cl.[2] ..... A63C 1/02

[52] U.S. Cl. ..... 280/11.12

[58] Field of Search ..... 280/11.12, 11.18, 11.17

[56] References Cited

U.S. PATENT DOCUMENTS

| | | | |
|---|---|---|---|
| 3,212,786 | 10/1965 | Florjancic et al. | 280/11.12 |
| 4,071,938 | 2/1978 | Chambers | 280/11.12 X |
| 4,074,909 | 2/1978 | Baikie | 280/11.12 |

*Primary Examiner*—Joseph F. Peters, Jr.
*Assistant Examiner*—Gene A. Church
*Attorney, Agent, or Firm*—Charles E. Brown

[57] ABSTRACT

The present invention is concerned with a blade support for an ice skate. The support comprises a structural unitary elongated frame constructed of plastic material or the like. The frame has a vertical wall with a transverse front sole plate and a rear heel plate for securing the frame to a skate boot. An elongated blade receiving channel is provided in a lower edge of the frame for receiving a top portion of a skate blade. Localizing cavities are provided in the channel to position the blade at a predetermined position therein. Fasteners extend transversely to the channel for removably securing the blade in the channel. A plurality of structural ribs extend over the vertical wall and are disposed under the sole plate and heel plate to strengthen the vertical wall.

11 Claims, 7 Drawing Figures

SKATE BLADE SUPPORT

BACKGROUND OF THE INVENTION (a) Field of the Invention

The present invention relates to an improved blade support for use with an ice skate and wherein the blade is easily detachably secured to the support frame.

(b) Description of Prior Art

Various types of ice skate structures and blade support frames are known. Many of these frames are constructed of metals, such as steel, making the skate relatively heavy. In the majority of the metal support frame structures, the blade is welded to the structure and the uppermost portion of the structure or support, is rivetted to a skate boot.

Blade supports constructed of plastic material, whereby to reduce the weight of the skate, have been introduced. However, the construction of some of these is such that the supports are weak and when subjected to a high impact force, such as provided by a fast travelling ice hockey puck, the plastic material may crack. Also, such frames are relatively difficult to install onto a skate boot and this can only be done at the factory.

It is also known to provide a blade support whereby the skate blade is replaceable. However, such structures have been found to be complex and the removal and installation of the blade is, therefore, not relatively simple. Also, localizing the blade at a proper position is also relatively difficult when interchanging blades. With some frames it is necessary to remove the frame from the boot in order to change the blade.

SUMMARY OF INVENTION

It is a feature of the present invention to provide an improved blade support constructed of a plastic material or the like and which substantially overcomes all of the above-mentioned disadvantages.

It is a further feature of the present invention to provide a blade support which is relatively light, very strong, and yet not bulky.

It is a further feature of the present invention to provide a blade support which is easily attachable to a skate boot and wherein the blade is easily replaceable.

According to the above features, from a broad aspect, the present invention provides a blade support for an ice skate, which support comprises a structural unitary elongated frame constructed of synthetic material and having a vertical wall defining opposed side faces. A transverse top attachment means is provided at an upper end of the vertical wall for securing the frame to an article of footwear. An elongated blade receiving channel is provided in a lower edge of the frame for receiving a top portion of a skate blade. Localizing means is provided in the channel to position the blade at a predetermined position therein. Securement means secures the blade in the channel. A plurality of structural ribs extend over the vertical wall to strengthen the vertical wall. These structural ribs are disposed on and extend outwardly of the opposed side faces of the vertical wall. At least one elongated structural rib extends along the lower edge of the frame. A plurality of depending structural ribs extend from the transverse top attachment means towards the elongated structural rib.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
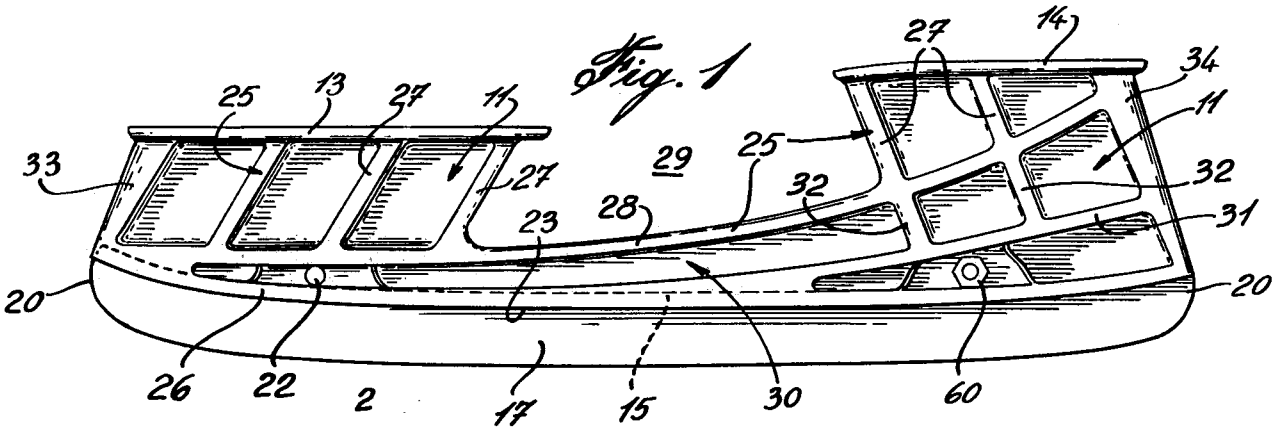
FIG. 1 is a side view of the blade support of the present invention showing a blade attached thereto.
Figure 2:
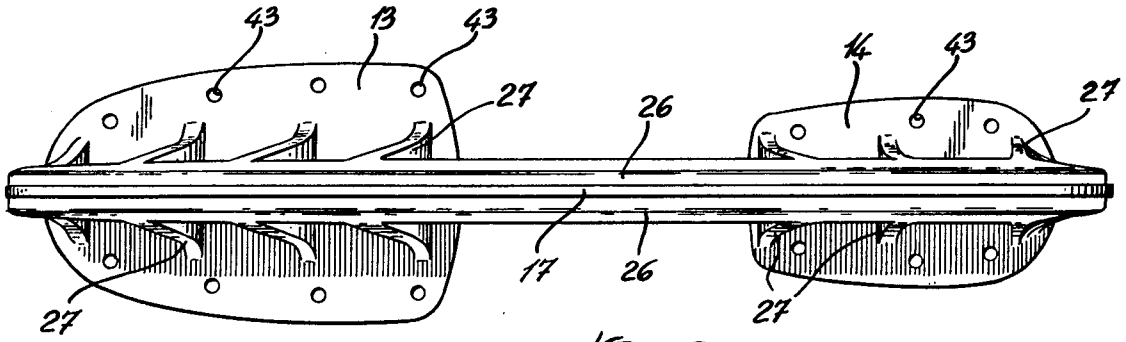
FIG. 2 is a bottom view of FIG. 1.

Referring now to the drawings and more particularly to FIGS. 1 to 4, there is shown generally at 10, the blade support of the present invention. The support comprises a structural unitary elongated frame 11 constructed of synthetic material, such as a suitable strong plastic. The frame 11 has a vertical wall 12 with a transverse top attachment means herein constituted by a front sole plate 13 and a rear heel plate 14 integrally formed with the vertical wall 12.

An elongated blade receiving channel 15 extends in a lower edge of the frame for receiving a top portion 16 of a skate blade 17 therein. Two localizing projections 18 are formed in the top edge 19 of the blade 17 and disposed adjacent a respective end 20 of the blade.

Localizing means, in the form of two cavities 20, are provided in the bottom wall 21 of the channel 15 and are contoured to receive an associated localizing projection 18 in close fit therein.

The top portion 16 of the blade 17 is secured in the channel 15 by securement means which is constituted by through bores 22 extending transverse to the wall 12 adjacent the lower edge 23 of the vertical wall 12 with at least one of the through bores 22 passing through a localizing cavity 20. The localizing projections 18 are also provided with through bores 24 whereby when the localizing projections 18 are in close fit within the cavities 20, the holes 24 will align with the holes 22 and a fastener is inserted through these holes to secure the blade to the frame. This will be described later with reference to FIG. 6.

As shown in FIG. 1, a plurality of structural ribs 25 are disposed over the vertical wall on opposed side faces thereof to strengthen the vertical wall 12. An elongated structural rib 26 is provided along the lower edge of the vertical wall 12 to permit the provision of the channel 15 and to strengthen the side walls thereof. A plurality of depending structural ribs 27 extend from the sole and heel plates 13 and 14, respectively, to a top elongated structural rib 28. The vertical wall 12 has an opening 29 between the sole and heel plates 13 and 14 and defines a bridge wall section 30 therebetween. The top elongated structural rib 28 extends along the top edge of the bridge wall section 30 and under the sole and heel plates 13 and 14. The depending structural ribs 27 are outwardly flared towards their respective one of the sole and heel plates and form integrally with the vertical wall 12 and the sole and heel plates. An intermediate structural rib 31 is provided in the rear portion of the vertical wall 12 between the top structural rib 28 and the elongated structural rib 26 in the lower edge of the vertical wall 12. Bridging ribs 32 extend between the longitudinal ribs 28 and 31 to solidify the wall 12 in the area therebetween. Additional bridging ribs (not shown) could be provided through the bridge wall section 30. End structural ribs 33 and 34 are provided along the front and rear edge of the vertical wall 12. Also, large ribs are provided about the through bores 22 to solidify the wall in this area. For aesthetic purpose, sheet-like material (not shown) having an adhesive on the back side thereof, may be removably attached to the vertical wall 12 in the cavities defined between the various structural ribs.

Figures 3, 4, 5, 6, 7:
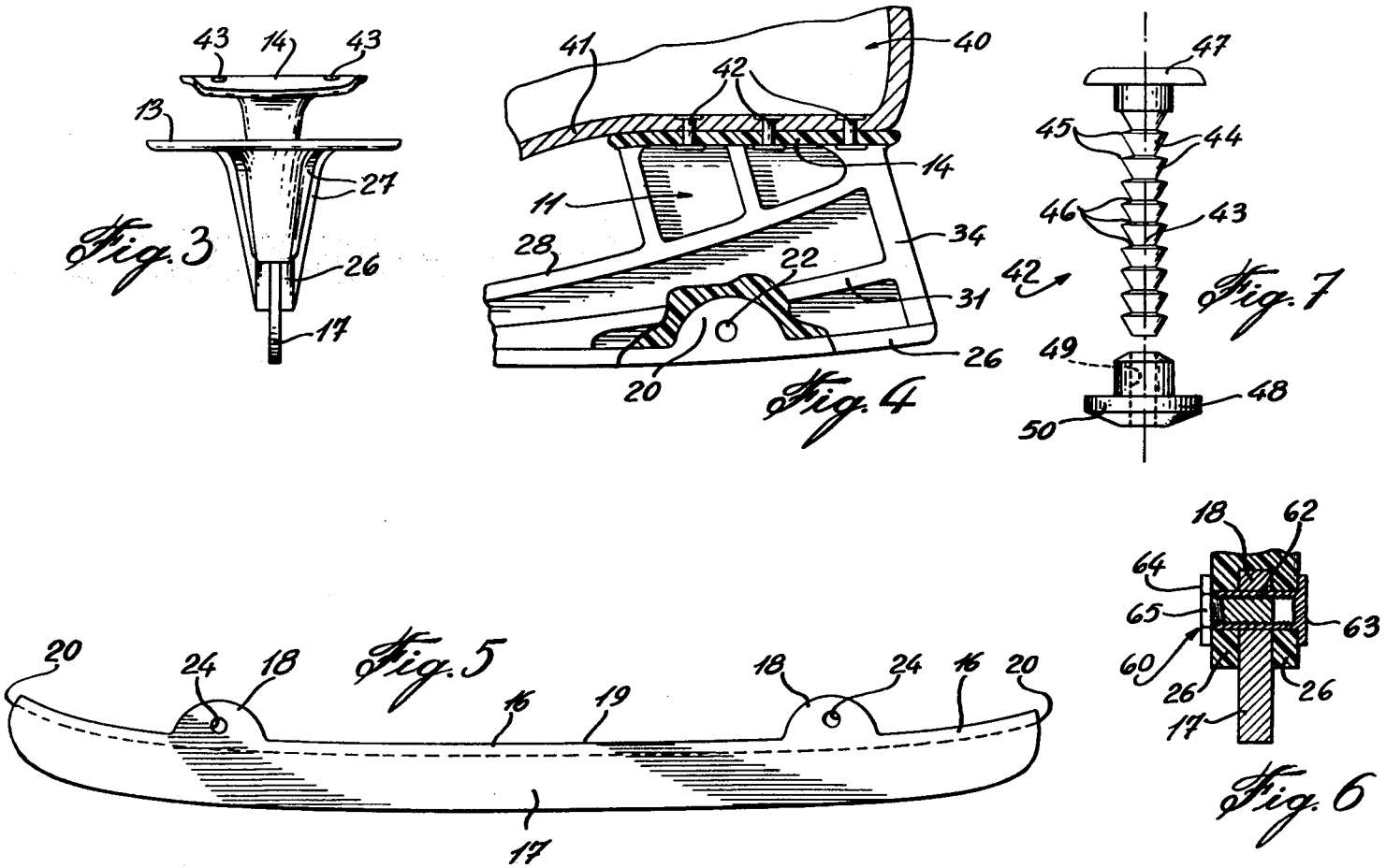
FIG. 3 is a front end view of FIG. 1.
FIG. 4 is a fragmented section view of the rear portion of the blade support showing its attachment to a skate boot.
FIG. 5 is a side view of the skate blade associated with the blade support.
FIG. 6 is a fragmented section view showing the manner in which the skate blade is secured to the blade support.
FIG. 7 is a side view of the fastener utilized to secure the blade support to a skate boot.

As shown in FIG. 3, the heel plate 14 is located in a plane substantially parallel to the sole plate 15 and elevated above the sole plate 15. This will accommodate and form an arch in a skate boot 40 (see FIG. 4) when secured thereto. As shown in FIG. 4, the boot 40 has the sole portion 41 thereof secured to the sole plate 13 and heel plate 14 by fasteners 42 extending through attachment holes 43 extending through the sole plate 13 and heel plate 14.

The fasteners 42 are preferably of the type as shown in FIG. 7 and comprise a stem 43 having a plurality of outwardly tapering annular ridges 44 each defining a gripping circumferential pointed edge 45 and a substantially narrow severing zone 46 between each of the annular ridges 44. A flat head 47 is formed at a top end of the stem 43. An appropriate synthetic resin bushing 48 having a through bore 49 therethrough of a diameter smaller than the diameter of the gripping circumferential edge of the annular ridges 44, extends through the bushing. The stem 43 is forced into the through bore 49 to expand the bushing and the pointed annular edge 45 will grip the wall of the through bore 49. The bushing 48 has an end flange 50. As shown in FIG. 4, to secure the sole 41 to the sole plate and heel plate, the stem extends through a hole made in the sole and through the holes 43 in the plates and the bushing is inserted in the opposite end. The stem 43 is pushed through the bushing 50 and the portion of the stem which extends outside the end flange 50 is snapped off the stem with a pair of pliers and will break in the severing zone 46 which is the weakest point of the stem. Alternatively, the stem could be cut off with side edge cutters or a metal cutting blade. Thus, there is provided a fastener which permits easy and positive securement of the blade support to a skate boot.

FIG. 6 illustrates the manner in which the skate blade 17 is secured to the blade support. The fastener 60 which extends through the through bore 20 of the blade support 10 and through the through bore 24 in the skate blade 17, is comprised of a female ferrule type member 61 having a cylindrical body 62 with an inner thread. The member 61 also has a head 63 at one end thereof. A threaded bolt 64 also having a head 65, is in threaded engagement in the cylindrical body 62 when the fastener is secured for retention of the blade in the channel. By threading the bolt 64 fully into the ferrule 62, the plastic material between the bolt and ferrule heads will provide outward pressure against the head causing the head to embed slightly within the outer surface of the vertical wall to prevent rotation of either the ferrule or the bolt. Also, this outward pressure will apply axial tension between the ferrule and the bolt in opposed direction which also prevents unthreading of the bolt in the ferrule.

It is pointed out that the provision of a vertical wall 12, reinforced with ribs for added rigidity, and disposed in a plane coextensive to the plane of the blade 17, results in a support which gives the wearer of an ice skate a better feel or sensitivity of the blade and thus more control when skating. All the action of skating, such as stopping, turning, etc., all depend on the transfer of force to the blade. The vertical wall 12 provides a direct transfer, in its shortest path, to the blade and thus a better response and strength. Also, there being no hollow parts, the support is less susceptible to breakages. Being a solid wall, the support does not generate vibrations which detract from skating due to its transfer both physical and audible.

It is within the ambit of the present invention to provide any obvious modifications of the preferred embodiment described hereinabove, provided such modifications fall within the scope of the broad claims appended hereto. For example, the attachmemt means may be formed as a lower shoe section having strapping whereby to connect the blade support to an ordinary shoe by means of the strapping.

I claim:

1. A blade support for an ice skate, said support comprising a structural unitary elongated frame constructed of synthetic material and having a vertical wall defining opposed side faces, a transverse top attachment means at an upper end of said vertical wall for securing said frame to an article of footwear, an elongated blade receiving channel in a lower edge of said frame for receiving a top portion of a skate blade, localizing means in said channel to position said blade at a predetermined position therein, securement means for securing said blade in said channel, a plurality of structural ribs extending over said vertical wall to strengthen said vertical wall, said structural ribs being disposed on and extending outwardly of said opposed side faces of said vertical wall, there being at least one elongated structural rib extending along said lower edge, and a plurality of depending structural ribs extending from said transverse top attachment means towards said elongated structural rib.

2. A blade support as claimed in claim 1, wherein said vertical wall extends throughout said elongated frame in alignment with the plane of said blade.

3. A blade support as claimed in claim 1, wherein said fasteners each comprise a stem having a plurality of outwardly tapering annular ridges defining a gripping circumferential pointed edge, a narrow severing zone between each said annular ridges, a flat head at a top end of said stem, and a synthetic material bushing having a through bore of smaller diameter than said stem at said gripping circumferential edge, said bushing having an end flange.

4. A blade support as claimed in claim 1, wherein said depending structural ribs are outwardly flared from above said elongated structural rib towards said top attachment means and formed integrally therewith and with said vertical wall and said elongated structural rib.

5. A blade support as claimed in claim 4 wherein said securement plates comprise a front sole plate and a rear heel plate, said sole plate and heel plate being spaced apart and extending over a front top portion and a rear top portion of said vertical wall, respectively; said sole plate and heel plate each having attachment means to secure said sole and heel plates to said skate boot, said vertical wall having an opening between said sole and heel plates and defining a bridge wall section therebetween, said bridge wall section having a top elongated structural rib adjacent an upper edge thereof, said top elongated structural rib extending over said vertical wall under said sole and heel plates and being spaced from said structural rib extending along said lower edge.

6. A blade support as claimed in claim 5 wherein an elongated cavity is defined between said top elongated structural rib and said structural rib extending along said lower edge, intermediate structural ribs bridging said elongated cavity at least about two spaced apart transverse through bores in said vertical wall bridging said channel, said through bores each receiving a fastener therethrough for securing said blade in said channel, said through bores and fasteners constituting said securement means.

7. A blade support as claimed in claim 6 wherein end structural ribs extend along a front and rear edge of said vertical wall, and a sheet-like material removably securable in said cavity on said vertical wall.

8. A blade support as claimed in claim 1 wherein said skate blade is removably secured in said channel, said blade being provided with at least one localizing projection on a top edge thereof, said localizing means being at least one cavity in a bottom wall of said channel and having a contour to receive said localizing projection in close fit therein, two or more spaced apart transverse through bores in said vertical wall bridging said channel, one of said through bores extending through said cavity, said skate blade having through bores therein adjacent said top edge and disposed for registry with said transverse through bores, and fasteners extending through said through bores of said vertical wall and skate blade to immovably secure a top edge portion of said skate blade in said channel.

9. A blade support as claimed in claim 8 wherein each said fasteners comprises a female ferrule type member having a cylindrical body with an inner thread and a head at one end of said body, a threaded bolt for threaded engagement in said cylindrical body and also having a head, when said fastener is secured for retention of said blade the respective heads have their inner surface in frictional engagement with a respective one of opposed surfaces of said vertical wall.

10. A blade support as claimed in claim 9 wherein said cylindrical body and threaded bolt are in axial tension when said fastener is secured for retention of said blade.

11. A blade support as claimed in claim 8 wherein said top attachment means comprises a front sole plate and a rear heel plate, said front sole plate and rear heel plate being secured to a sole of a skate boot.

* * * * *

UNITED STATES PATENT AND TRADEMARK OFFICE

CERTIFICATE OF CORRECTION

PATENT NO. : 4,150,837

DATED : April 24, 1979

INVENTOR(S) : Peter F. Zuuring

It is certified that error appears in the above-identified patent and that said Letters Patent are hereby corrected as shown below:

Claim 3, line 2, cancel "fasteners each comprise" and insert -- top attachment means comprise a front sole plate and a rear heel plate, said sole plate and heel plate being spaced apart and extending over a front top portion and a rear top portion of said vertical wall, respectively, said sole plate and heel plate each having attachment means to secure said sole and heel plates to an article of footwear, said attachment means being holes in said sole and heel plates receiving fasteners, each fastener comprising --.

Claim 5, line 2, cancel "securement plates" and

UNITED STATES PATENT AND TRADEMARK OFFICE

CERTIFICATE OF CORRECTION

PATENT NO. : 4,150,837 Page 2 of 2

DATED : April 24, 1979

INVENTOR(S) : Peter F. Zuuring

It is certified that error appears in the above-identified patent and that said Letters Patent are hereby corrected as shown below:

substitute -- transverse top attachment means --;

Claim 5, line 7, cancel "said skate boot" and insert -- an article of footwear --.

Claim 7, line 1, change "6" to read -- 5 --.

Claim 11, line 4, cancel "a skate boot" and insert -- an article of footwear --.

Signed and Sealed this

Second Day of December 1980

[SEAL]

Attest:

SIDNEY A. DIAMOND

Attesting Officer

Commissioner of Patents and Trademarks